US009010063B2

(12) United States Patent
Spruiell

(10) Patent No.: US 9,010,063 B2
(45) Date of Patent: Apr. 21, 2015

(54) CONSTRUCTION BRACKET AND METHOD OF USE

(76) Inventor: Scott E. Spruiell, Tracy, CA (US)

( * ) Notice: Subject to any disclaimer, the term of this patent is extended or adjusted under 35 U.S.C. 154(b) by 660 days.

(21) Appl. No.: 12/574,867

(22) Filed: Oct. 7, 2009

(65) Prior Publication Data

US 2011/0078975 A1 Apr. 7, 2011

(51) Int. Cl.

| | |
|---|---|
| ***E04B 1/38*** | (2006.01) |
| ***E04G 21/18*** | (2006.01) |
| ***E04B 1/26*** | (2006.01) |
| *E04B 1/24* | (2006.01) |

(52) U.S. Cl.

CPC ..... *E04G 21/185* (2013.01); *E04B 2001/2463* (2013.01); *E04B 1/2608* (2013.01)

(58) Field of Classification Search

CPC ..... E04B 1/2608; E04B 2001/2463; E04G 21/185; F16L 3/14

USPC ..... 52/699, 702, 701, 715, 712, 98, 100, 52/220.1, 220.8, 293.3, 295, 846; 248/65, 248/73, 218.4, 219.4, 227.3, 534, 74.3, 248/300; 249/91, 207

See application file for complete search history.

(56) References Cited

U.S. PATENT DOCUMENTS

| | | | | | |
|---|---|---|---|---|---|
| 2,103,064 | A | * | 12/1937 | Clark | 52/696 |
| 2,273,571 | A | | 2/1942 | Hafemeister | |
| 2,687,864 | A | * | 8/1954 | Kohler | 248/74.4 |
| D184,508 | S | * | 3/1959 | Burt | D8/373 |
| 3,034,185 | A | * | 5/1962 | Olsen | 403/347 |
| 3,150,429 | A | * | 9/1964 | Shaffer | 249/207 |
| 3,979,093 | A | * | 9/1976 | Madden | 248/56 |
| 4,312,487 | A | * | 1/1982 | Kimura | 248/73 |
| D266,328 | S | * | 9/1982 | Fleshman | D15/144 |
| 4,413,456 | A | * | 11/1983 | Gilb | 52/295 |
| D304,675 | S | | 11/1989 | Rogers | |
| 5,125,619 | A | | 6/1992 | Collins | |
| 5,146,720 | A | | 9/1992 | Turner | |
| 5,367,848 | A | * | 11/1994 | McConnohie | 52/336 |
| 5,370,344 | A | | 12/1994 | Nadherny | |
| 5,395,079 | A | | 3/1995 | Jensen et al. | |

(Continued)

*Primary Examiner* — Robert Canfield
(74) *Attorney, Agent, or Firm* — Edward S. Wright

(57) ABSTRACT

Bracket for holding a pipe in position during the pouring of a concrete foundation and thereafter serving as a nail shield for the pipe and/or as a structural tie or strap in constructing a wall on the foundation. The bracket has an upright base engagable with an inner face of a form board, and first and second flanges extending in opposite directions from the base for engagement with an upper edge of the form board and with the pipe, with the first flange being bendably attached to the base in a manner permitting it to be bent from a horizontal position perpendicular to the pipe to an upright, shielding position parallel to the pipe. The bracket is attached to the form board with the first flange in its horizontal position on top of the board, and the pipe is attached to the second flange, with a portion of the pipe extending above the form board. Concrete is poured to the top of the form board and allowed to set. The fasteners securing the upper flange to the form board are removed, the form board is stripped away from the concrete, and the upper flange of the bracket is bent from the horizontal position to the upright position. A bottom plate for a wall is installed on top of the concrete along the side of the foundation, with the pipe extending through an opening in the bottom plate and the upright flange extending along a side edge of the bottom plate adjacent to the opening to provide a nail shield for the pipe. The flange is affixed to the bottom plate on opposite sides of the opening to tie the bottom plate together across the opening.

17 Claims, 2 Drawing Sheets

(56) References Cited

U.S. PATENT DOCUMENTS

| | | | | |
|---|---|---|---|---|
| 5,438,795 | A * | 8/1995 | Galbraith | 47/46 |
| 5,598,682 | A | 2/1997 | Haughian | |
| 5,611,179 | A * | 3/1997 | Leek | 52/293.3 |
| 5,624,089 | A | 4/1997 | Nadherny et al. | |
| 5,642,597 | A * | 7/1997 | Hendrickson | 52/715 |
| 5,670,076 | A * | 9/1997 | Leek | 249/53 M |
| 5,678,379 | A * | 10/1997 | Quattrociocchi | 52/712 |
| 5,729,939 | A * | 3/1998 | Di Benedetto | 52/293.3 |
| 5,797,694 | A * | 8/1998 | Breivik | 403/231 |
| 5,806,813 | A * | 9/1998 | Binelli | 248/73 |
| 5,937,609 | A | 8/1999 | Roth | |
| 6,138,425 | A * | 10/2000 | Wendt | 52/506.07 |
| 6,176,057 | B1 * | 1/2001 | Bouchet et al. | 52/514 |
| 6,185,824 | B1 * | 2/2001 | McClure et al. | 30/229 |
| 6,254,306 | B1 * | 7/2001 | Williams | 403/403 |
| 6,672,029 | B2 | 1/2004 | Tucker | |
| 6,711,867 | B1 * | 3/2004 | Smith | 52/696 |
| 6,870,101 | B1 * | 3/2005 | Hull et al. | 174/58 |
| 6,945,735 | B1 | 9/2005 | Doverspike | |
| 7,021,022 | B2 * | 4/2006 | Hearne | 52/715 |
| 7,127,862 | B2 * | 10/2006 | Saldana | 52/715 |
| 7,131,792 | B2 | 11/2006 | Doverspike | |
| 7,150,437 | B1 * | 12/2006 | Teeters | 248/70 |
| 7,216,465 | B2 | 5/2007 | Saldana | |
| 7,216,466 | B2 * | 5/2007 | Nystrom | 52/712 |
| 7,455,278 | B2 * | 11/2008 | Hsu | 248/675 |
| 7,475,862 | B1 * | 1/2009 | Anspach | 249/34 |
| 7,487,597 | B2 * | 2/2009 | Diaz | 33/562 |
| 8,082,701 | B1 * | 12/2011 | Wendel | 52/127.5 |
| 2003/0126824 | A1 * | 7/2003 | Jensen | 52/715 |
| 2005/0218270 | A1 | 10/2005 | Doverspike | |
| 2005/0244230 | A1 | 11/2005 | Doverspike | |
| 2005/0284988 | A1 * | 12/2005 | Lawver | 248/65 |
| 2009/0173844 | A1 * | 7/2009 | Huo | 248/65 |

* cited by examiner

CONSTRUCTION BRACKET AND METHOD OF USE

BACKGROUND OF THE INVENTION

1. Field of Invention

This invention pertains generally to building and construction and, more particularly, to a bracket for holding a pipe in a predetermined position during the pouring of a concrete foundation and thereafter serving as a nail shield for the pipe and/or as a structural tie or strap in constructing a wall on the foundation.

2. Related Art

Various techniques are employed for holding embedded pipes in position during the pouring of concrete slab foundations. Such pipes have, for example, been attached to stakes driven into the ground or to form boards which contain the concrete and support it while it hardens and sets. However, attaching pipes directly to the form boards or to blocks attached to the form boards can leave portions of the pipes exposed when the form boards are stripped from the foundation and can also lead to misalignment of the pipes in walls built on the foundation.

Brackets have also been provided for holding pipes in spaced relation to form boards so they can be fully embedded in the concrete, and examples of such brackets are found in U.S. Pat. Nos. 5,125,619 and 6,672,029. These brackets are of limited application in that they are removed after the concrete has set and serve no function other than holding the pipes in position during the pouring and hardening of the concrete.

OBJECTS AND SUMMARY OF THE INVENTION

It is, in general, an object of the invention to provide a new and improved bracket and method for holding a pipe during the pouring of a concrete foundation, shielding the pipe from nails during construction of a wall on the foundation, and/or tying structural members of such a wall together.

Another object of the invention is to provide a bracket and method of the above character which overcome the limitations and disadvantages of the prior art.

These and other objects are achieved in accordance with the invention by providing a bracket having an upright base engagable with an inner face of a form board, and first and second flanges extending in opposite directions from the base for engagement with an upper edge of the form board and with the pipe, with the first flange being bendably attached to the base in a manner permitting it to be bent from a horizontal position perpendicular to the pipe to an upright, shielding position parallel to the pipe.

The bracket is attached to the form board with the first flange in its horizontal position on the top side of the board, and the pipe is attached to the second flange, with a portion of the pipe extending above the form board. Concrete is poured to the top of the form board and allowed to set. The fasteners securing the upper flange to the form board are removed, the form board is stripped away from the concrete, and the upper flange of the bracket is bent from the horizontal position to the upright or vertical position. A bottom plate for a wall is installed on top of the concrete along the side of the foundation, with the pipe extending through an opening in the bottom plate and the upright flange extending along a side edge of the bottom plate adjacent to the opening to provide a nail shield for the pipe. The flange is affixed to the bottom plate on opposite sides of the opening to tie the bottom plate together across the opening.

DETAILED DESCRIPTION

Figure 1:
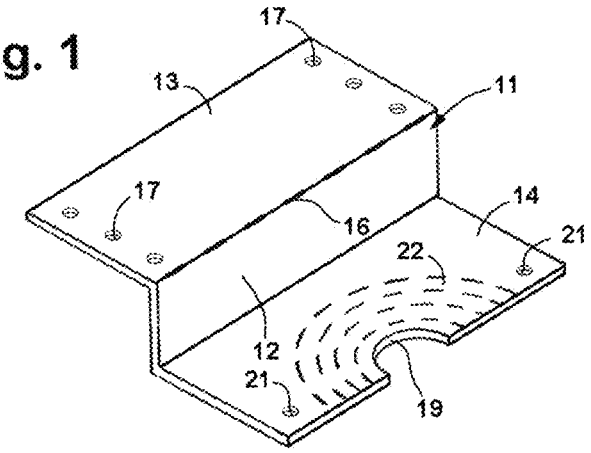
FIG. 1 is an isometric view of one embodiment of a pipe holder and nail shield according to the invention.

As illustrated in FIG. 1, the bracket 11 is fabricated of sheet metal and has a generally rectangular, upright base 12, with generally rectangular flanges 13, 14 extending horizontally in opposite directions from the upper and lower edges of the base. A line of perforations in the form of notches or slots 16 is formed along the corner between the base and the upper flange to facilitate bending of the upper flange from the horizontal position perpendicular to the base to an upright position in the plane of the base.

Holes 17 are formed in the upper flange for receiving nails or other fasteners such as screws or staples for attaching the upper flange to a form board during the pouring of a concrete foundation and thereafter to a framing member such as a bottom plate for a wall constructed on top of the foundation.

A semicircular opening or notch 19 having a diameter corresponding to the the outside diameter of the pipe to be held opens through the outer or distal edge of the lower flange, and holes 21 are formed on opposite sides of the opening near the outer edge of the flange for receiving a wire or other tie which holds the pipe in the notch. A plurality of semi-annular knockouts 22 are disposed concentrically of the notch and can be selectively removed to accommodate pipes of different sizes.

The bracket is intended primarily for use with pipes that extend from a foundation into a wall built on top of the foundation, and the dimensions of the bracket are preferably such that the pipe will be centered within the wall. Thus, for a wall built along the edge of a foundation, the length of the lower flange is such that the outer edge of the flange will lie along the centerline of the wall when the base of the bracket is in abutting engagement with the inner face of a form board on that side of the foundation.

Figure 2:
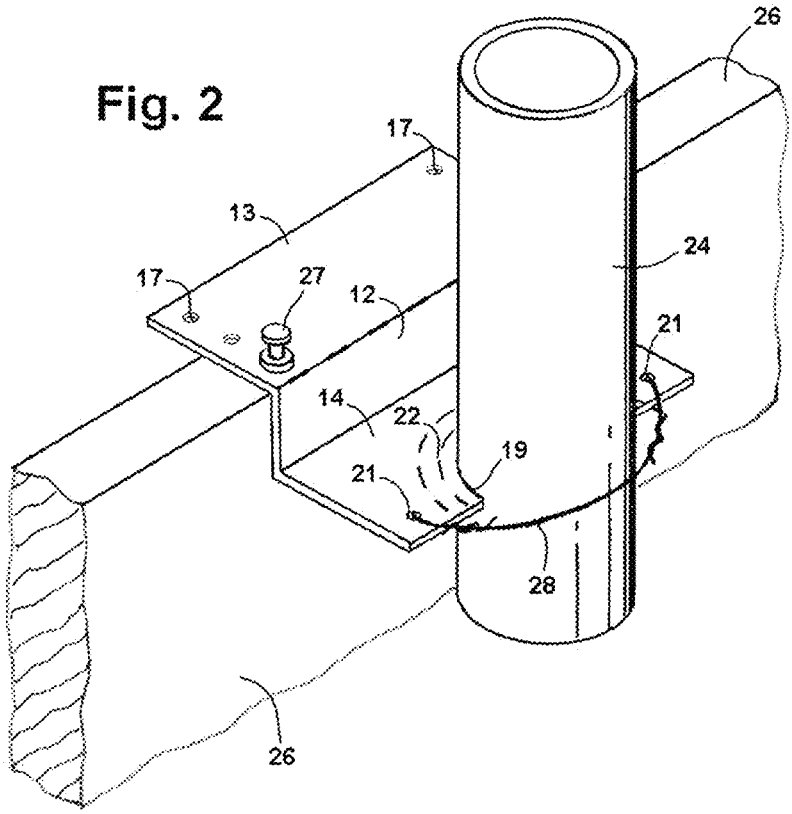
FIG. 2 is an isometric view of the embodiment of FIG. 1 holding a pipe in a fixed position relative to a form board for a concrete foundation.

In FIG. 2, the bracket is shown in connection with a pipe 24 and a 2×12 form board 26 for an on-grade concrete slab foundation or stem wall. Upper flange 13 is attached to the top side of the form board with duplex nails 27, with base 12 abutting against the inner face of the form board. Some of the knockouts 22 are removed from lower flange 14 to provide a notch 19 of suitable diameter for the size of the pipe, and the pipe is secured to the flange by a tie wire 28 which passes through holes 21. The pipe is thus held securely in an upright position away from the form board, with a portion of the pipe extending above the form board where a wall will be built.

Concrete is poured about the pipe to the top of the form board to complete the foundation, with the lower portion of the pipe and the lower flange of the bracket being embedded in the concrete. After the concrete has hardened or set, nails 27 are removed from the form board and bracket, and the form board is stripped from the side of the foundation.

Figure 3:
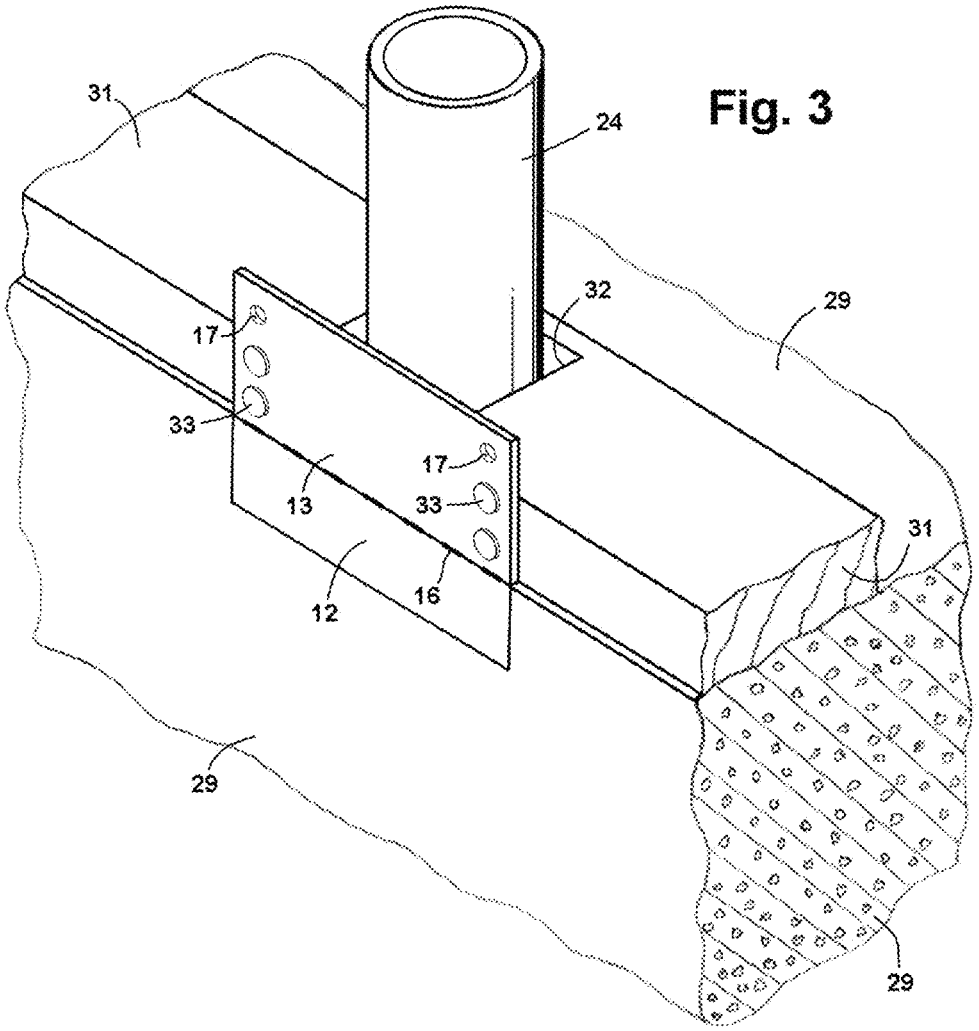
FIG. 3 is an isometric view of the embodiment of FIG. 1 serving as a nail shield for a pipe in a wall built on a concrete foundation.

As illustrated in FIG. 3, upper flange 13 is bent from its horizontal position to an upright position where it is substantially coplanar with base 12 at the side of the foundation 29. A 2×4 bottom plate 31 for a wall is installed along the edge of the foundation, with the pipe extending through an opening 32 in the plate. In the embodiment illustrated, the opening is in the form of a rectangular notch which opens through the outer edge of the plate. However, it can be of any desired configuration such as a circular or rectangular opening or a gap in the plate.

Upper flange 13 abuts against the outer edge of the bottom plate in spaced, parallel relation to the pipe and is affixed to the plate by nails 33 or other suitable fasteners. The flange is taller than the bottom plate in the embodiment illustrated and serves as a nail shield for the pipe during construction of the wall. In addition, with the flange being attached to the bottom plate on opposite sides of the opening for the pipe, it ties the bottom plate together across the opening.

The invention has a number of important features and advantages. It provides a bracket which holds a pipe securely in place during the pouring of a concrete foundation and also provides accurate positioning of the pipe in a wall built on the foundation. The bracket also serves as a nail shield for the pipe and as a structural tie for a framing member at the base of the wall. It can be manufactured economically and easily with existing tools, and it should reduce construction costs by reducing the time required to position a pipe and by combining three functions into one bracket.

Although the bracket has been described and illustrated in connection with a single pipe, it can also be used to position and protect more than one pipe by including notches for an additional pipe or pipes in the lower flange and dimensioning the bracket accordingly.

It is apparent from the foregoing that a new and improved construction bracket and method have been provided. While only certain presently preferred embodiments have been described in detail, as will be apparent to those familiar with the art, certain changes and modifications can be made without departing from the scope of the invention as defined by the following claims.

The invention claimed is:

1. A sheet metal bracket with means for holding a pipe in a predetermined position relative to a form board during the pouring of a concrete foundation and means for shielding the pipe from nails used in constructing a wall on the foundation.

2. The bracket of claim 1 comprising: a planar, upright base section engagable with an inner face of the form board, and first and second flanges extending in opposite directions in horizontal planes from upper and lower edges of the base section for engagement with an upper edge of the form board and with the pipe, the first flange being attached to the base section in a manner that facilitates bending of the first flange from a horizontal position perpendicular to the pipe to an upright, shielding position parallel to the pipe after the foundation is poured.

3. The bracket of claim 2 including an opening in the second flange for receiving the pipe.

4. The bracket of claim 2 including a hole in the second flange for receiving a tie that secures the pipe to the bracket while the foundation is poured.

5. The bracket of claim 2 including at least one hole in the first flange for receiving fasteners that secure the bracket to the form board when the flange is in the horizontal position and to a framing member of the wall when the flange is in an upright position.

6. The bracket of claim 2 wherein the base section is generally rectangular.

7. The bracket of claim 2 wherein the bracket is fabricated of sheet metal bent to form the base section and the flanges, with a line of perforations between the first flange and the base section that facilitates the bending of the first flange from the horizontal position to the upright, shielding position.

8. The bracket of claim 1 comprising a planar, upright base section having generally parallel upper and lower edges, an upper flange attached to the upper edge of the base section in a manner that facilitates movement of the flange from a horizontal position perpendicular to the base section to an upright position coplanar with the base section, a lower flange extending horizontally from the lower edge of the base section in a direction opposite to the upper flange, an opening in the lower flange for receiving a pipe, and an opening in the upper flange for receiving a fastener for securing the bracket to a forming board and/or a framing member.

9. The bracket of claim 8 wherein the base section and flanges are formed as a unitary structure, with a line of perforations between the upper flange and the base section that facilitates the movement of the upper flange from the horizontal position to the upright position.

10. A bracket for holding a pipe in a predetermined position relative to a form board during the pouring of a concrete foundation and thereafter shielding the pipe from nails used in constructing a wall on the foundation, comprising: a planar, upright base section engagable with an inner face of the form board, and first and second flanges extending in opposite directions in horizontal planes from upper and lower edges of the base section for engagement with an upper edge of the form board and with the pipe, the first flange being attached to the base section in a manner that facilitates bending of the first flange from a horizontal position perpendicular to the pipe to an upright, shielding position parallel to the pipe after the foundation is poured, and a plurality of knockouts in the second flange with diameters corresponding to pipes of different sizes.

11. A pipe holder and nail shield, comprising: a planar, upright base section having generally parallel upper and lower edges, an upper flange attached to the upper edge of the base section in a manner that facilitates movement of the flange from a horizontal position perpendicular to the base section to an upright position coplanar with the base section, a lower flange extending horizontally from the lower edge of the base section in a direction opposite to the upper flange, a plurality of concentric, semi-annular knockouts in the lower flange which can be selectively removed to form semicircular openings for receiving pipes of different diameters, and an opening in the upper flange for receiving a fastener for securing the bracket to a forming board and/or framing member.

12. A pipe holder and nail shield, comprising: a planar, upright base section having generally parallel upper and lower edges, an upper flange attached to the upper edge of the base section in a manner that facilitates movement of the flange from a horizontal position perpendicular to the base section to an upright position coplanar with the base section, and a lower flange extending horizontally from the lower edge of the base section in a direction opposite to the upper flange, with the lower flange in holding engagement with a pipe about which concrete is to be poured in constructing a foundation and the upper flange affixed in its horizontal position to an upper edge of a form board for the foundation to hold the pipe in a predetermined upright position relative to the form board.

13. A pipe holder and nail shield, comprising: a planar, upright base section having generally parallel upper and lower edges, an upper flange attached to the upper edge of the base section in a manner that facilitates movement of the flange from a horizontal position perpendicular to the base section to an upright position coplanar with the base section, and a lower flange extending horizontally from the lower edge of the base section in a direction opposite to the upper flange, with the lower flange embedded in a concrete foundation, the upper flange in its upright position and affixed to a framing member of a wall constructed on the foundation, and a pipe extending from the foundation into the wall and the upper flange serving as a nail shield for the pipe.

14. The pipe holder and nail shield of claim 13 wherein the framing member is a bottom plate having an opening though which the pipe extends, with fasteners securing the upper flange to a lateral edge of the bottom plate on opposite sides of the opening to tie the bottom plate together across the opening.

15. A pipe holder and nail shield, comprising: a planar base section having first and second generally parallel edges, a first flange extending from the first edge in a direction perpendicular to the base section, with a line of perforations along the first edge that facilitates bending the first flange to a position substantially coplanar with the base section, a second flange extending from the second edge of the base section in a direction perpendicular to the base section and opposite to the first flange, a plurality of holes in the first flange for receiving fasteners that connect the first flange to a support, a semicircular opening in an edge of the second flange for receiving a pipe, and openings in the second flange on opposite sides of the semicircular opening for receiving a tie for securing the pipe to the bracket.

16. The pipe holder and nail shield of claim 15 including a plurality of semi-annular knockouts disposed concentrically of the semicircular opening to accommodate pipes of different diameters.

17. The pipe holder and nail shield of claim 15 wherein the base section and the flanges are formed as a unitary structure of sheet metal.

* * * * *